US008230576B2

(12) United States Patent
Masaki

(10) Patent No.: US 8,230,576 B2
(45) Date of Patent: Jul. 31, 2012

(54) METHOD OF MANUFACTURING CAPACITIVE ELECTROMECHANICAL TRANSDUCER

(75) Inventor: Yuichi Masaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/957,784

(22) Filed: Dec. 1, 2010

(65) Prior Publication Data

US 2011/0154649 A1 Jun. 30, 2011

(30) Foreign Application Priority Data

Dec. 25, 2009 (JP) ..... 2009-293914

(51) Int. Cl.
*H04R 31/00* (2006.01)

(52) U.S. Cl. ..... 29/594; 29/25.41; 29/25.42; 257/254; 257/416; 381/174; 381/191; 438/53

(58) Field of Classification Search ..... 29/594, 29/25.41, 25.42; 257/254, 416; 381/174, 381/191; 438/53
See application file for complete search history.

(56) References Cited

U.S. PATENT DOCUMENTS

| | | | | |
|---|---|---|---|---|
| 4,262,399 | A | 4/1981 | Cady | 29/25.42 |
| 5,543,013 | A * | 8/1996 | Tsang et al. | 438/52 |
| 5,619,476 | A | 4/1997 | Haller et al. | 367/181 |
| 5,982,709 | A | 11/1999 | Ladabaum et al. | 367/170 |
| 6,271,620 | B1 * | 8/2001 | Ladabaum | 310/334 |
| 6,992,420 | B2 | 1/2006 | Jang et al. | 310/324 |
| 2008/0194053 | A1 * | 8/2008 | Huang | 438/53 |
| 2010/0066423 | A1 | 3/2010 | Inukai et al. | 327/163 |

FOREIGN PATENT DOCUMENTS

JP 2006-319712 A 11/2006

OTHER PUBLICATIONS

P.-C. Eccardt, et al., "Micromachined Transducers for Ultrasound Applications," IEEE Ultrasonics Symposium, pp. 1609-1618 (1997).
A.S. Ergun, et al., "Capacitive Micromachined Ultrasonic Transducers: Fabrication Technology," IEEE Transactions on Ultrasonics, Ferroelectrics, and Frequency Control, vol. 52, No. 12, pp. 2242-2258 (Dec. 2005).

* cited by examiner

*Primary Examiner* — A. Dexter Tugbang
*Assistant Examiner* — Jeffrey T Carley
(74) *Attorney, Agent, or Firm* — Fitzpatrick, Cella, Harper & Scinto

(57) ABSTRACT

Provided is a method of manufacturing a capacitive electromechanical transducer, including: forming a lower electrode layer on a substrate; forming a sacrificial layer on the lower electrode layer; forming by application a resist layer on the sacrificial layer to form a cavity pattern; forming an insulating layer above regions including a region that contains the resist layer used to form the cavity pattern, and then removing a part of the insulating layer that is formed above the resist layer along with the resist layer, thereby leaving the insulating layer in the other regions than the region where the cavity pattern has been formed; forming a vibrating film above the region where the cavity pattern has been formed and the regions where the insulating layer remains; and removing the sacrificial layer to form a cavity.

4 Claims, 3 Drawing Sheets

METHOD OF MANUFACTURING CAPACITIVE ELECTROMECHANICAL TRANSDUCER

BACKGROUND OF THE INVENTION

1. Field of the Invention

The present invention relates to a method of manufacturing a capacitive electromechanical transducer which is used as a capacitive micromachined ultrasonic transducer or the like.

2. Description of the Related Art

In recent years, a capacitive electromechanical transducer manufactured through a micromachining process has been researched actively.

A general capacitive electromechanical transducer has a lower electrode, a vibrating film, which is supported to keep a given distance from the lower electrode, and an upper electrode, which is disposed on a surface of the vibrating film.

This capacitive electromechanical transducer is used as, for example, a capacitive micromachined ultrasonic transducer (CMUT).

This kind of capacitive micromachined ultrasonic transducer has a feature that a light-weight vibrating film is used to transmit and receive ultrasonic waves, and that it is easy to obtain a capacitive micromachined ultrasonic transducer that has excellent broadband characteristics in liquids as well as in the air. The CMUT enables more accurate diagnosis than conventional medical diagnosis, and is therefore beginning to attract attention as a promising technology.

Next, the operation principle of the capacitive micromachined ultrasonic transducer is described. To transmit ultrasonic waves, a DC voltage superimposed with a minute AC voltage is applied between the lower electrode and the upper electrode. This causes the vibrating film to vibrate, thereby generating ultrasonic waves.

When ultrasonic waves are received, the vibrating film is deformed by the ultrasonic waves, and hence the deformation causes a capacity change between the lower electrode and the upper electrode, from which signals are detected.

In the capacitive electromechanical transducer, theoretical sensitivity is in inverse proportion to the square of the distance between its electrodes (gap).

A gap of 100 nm or less is necessary to manufacture a highly sensitive transducer, and study has recently been made on the gap in the CMUT of as narrow as 2 μm to approximately 100 nm (and further 100 nm or less).

Meanwhile, a commonly employed method of forming the gap in the capacitive electromechanical transducer involves providing a sacrificial layer that is as thick as a gap between the electrodes, forming the vibrating film on top of the sacrificial layer, and then removing the sacrificial layer.

This and similar technologies are disclosed in, for example, U.S. Pat. No. 4,262,399.

The method involving removing the sacrificial layer described in U.S. Pat. No. 4,262,399 has the following problems.

In this method, the progress of etching determines the cavity size, and hence, when multiple cavities are formed, sacrificial layer pieces for forming the multiple cavities may be etched unequally due to differences in film thickness, film quality, and the like between the sacrificial layer pieces. The resultant problem is uneven cavity size.

One of the possible solutions for this problem is to form each sacrificial layer piece for forming a cavity into the exact shape and size intended in advance, and to remove the sacrificial layer piece through an etching hole which is provided after the vibrating film is layered on top of the sacrificial layer.

However, according to this method, the vibrating film is formed after the patterning of the sacrificial layer, and hence the vibrating film needs to be thicker than a thickness enough to satisfy the step coverage in places where steps are formed by the sacrificial layer, and therefore needs to allow for the thickness margin. Giving the vibrating film a thickness that is thicker than necessary can cause a problem in that vibration characteristics are adversely affected.

In other places than cavities, on the other hand, the vibrating film needs to have a given thickness or more because a parasitic capacitance generated between the upper wiring and the lower wiring via the vibrating film takes a large value and greatly affects the sensor's sensitivity when the vibrating film is thin.

The thickness of the vibrating film thus needs to be controlled to an optimum value by taking into account its influence over the characteristics of the vibrating film which varies depending on where the vibrating film is formed.

SUMMARY OF THE INVENTION

In view of those problems, an object of the present invention is to provide a method of manufacturing a capacitive electromechanical transducer capable of suppressing the influence of parasitic capacitance over reception sensitivity by reducing the parasitic capacitance and of improving the degree of freedom in process design.

A method of manufacturing a capacitive electromechanical transducer according to the present invention includes; forming a lower electrode layer on a substrate, forming a sacrificial layer on the lower electrode layer, forming by application a resist layer on the sacrificial layer to form a cavity pattern, forming an insulating layer above regions including a region that contains the resist layer used to form the cavity pattern, and then removing a part of the insulating layer that is formed above the resist layer along with the resist layer, thereby leaving the insulating layer in the other regions than the region where the cavity pattern has been formed, forming a vibrating film above the region where the cavity pattern has been formed and the regions where the insulating layer remains; and removing, after the vibrating film is formed, the sacrificial layer from the region where the cavity pattern has been formed to form a cavity.

According to the method of manufacturing a capacitive electromechanical transducer of the present invention, the influence of parasitic capacitance over reception sensitivity may be suppressed by reducing the parasitic capacitance and the degree of freedom in process design may be improved.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The structure of the present invention allows to employ a method in which a lower electrode layer is formed on a substrate (for example, a glass substrate), a material of a sacrificial layer is deposited to form a layer on the lower electrode layer, and a pattern for forming cavities is etched by photolithography.

According to this method, an insulating layer is formed before a resist layer is removed.

Specifically, an insulating layer is formed above regions including a region that contains a resist layer used to form the cavity pattern, and then a part of the insulating layer that is formed above the resist layer is removed along with the resist layer, thereby leaving the insulating layer in the other regions than the region where the cavity pattern has been formed.

The method is capable of thoroughly filling a space between cavities with an insulating layer that is formed by vacuum deposition to the same thickness as that of the sacrificial layer. The step coverage is therefore satisfied by a vibrating film, and the vibrating film can have a thickness less than the depth of the cavities without causing a problem of step coverage.

The method is also capable of forming the insulating layer without needing an additional photolithography step, and widens the range of film thickness design values for a thin film material that forms the vibrating film. As a result, a capacitive electromechanical transducer that is inexpensive and high in sensitivity can be provided.

In the present invention, the terms "upper electrode" and "lower electrode" are used for the sake of convenience, and electrodes in the present invention only need to be arranged such that a first electrode and a second electrode are capacitively coupled at a given distance.

Examples of the present invention are described below.

EXAMPLE 1

As Example 1, a method of manufacturing a capacitive electromechanical transducer according to Example 1 of the present invention is described with reference to FIGS. 1A to 1E and FIGS. 2A to 2D.

FIGS. 1A to 1E and FIGS. 2A to 2D illustrate in section the structure of a capacitive electromechanical transducer that is manufactured according to Example 1. The sectional views of FIGS. 1A to 1E and FIGS. 2A to 2D are taken along the line A-A' of FIG. 4, which is a plan view illustrating the completed capacitive electromechanical transducer.

Figure 1A:
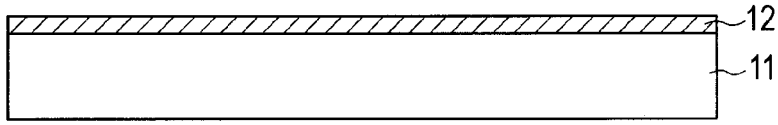
FIGS. 1A, 1B, 1C, 1D, and 1E are diagrams illustrating a method of manufacturing a capacitive electromechanical transducer according to Example 1 of the present invention, with FIG. 1A illustrating a step of forming a lower electrode layer, FIG. 1B illustrating a step of forming a chromium sacrificial layer, FIG. 1C illustrating a photolithography (exposure) step for forming a cavity pattern, FIG. 1D illustrating a step of forming a chromium cavity pattern, and FIG. 1E illustrating a step of forming an insulating layer.

The step illustrated in FIG. 1A is a step of forming a lower electrode layer in which a lower electrode is formed from titanium by sputtering on a glass substrate 11.

The substrate 11 may be made from other materials, for example, quartz, sapphire, or silicon.

Preferred deposition conditions in this step are as follows.

A chamber in which the process is conducted is pumped until a degree of vacuum of $3\times10^{-5}$ Pa is reached. Thereafter, titanium is deposited for 200 seconds, with the flow rate of Ar set to 30 sccm, the pressure to 0.7 Pa, and the DC power to 400 W, to form a titanium film to a thickness of approximately 100 nm.

Figure 1B:
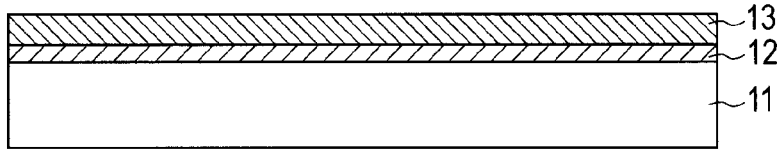

FIG. 1B illustrates a subsequent step of forming a chromium sacrificial layer in which a sacrificial layer 13 is formed from chromium by sputtering.

Preferred deposition conditions in this step are as follows.

A chamber in which the process is conducted is pumped until a degree of vacuum of $3\times10^{-5}$ Pa is reached. Thereafter, chromium is deposited for 500 seconds, with the flow rate of Ar set to 50 sccm, the pressure to 0.9 Pa, and the DC power to 400 W, to form a chromium film to a thickness of approximately 200 nm.

Figure 1C:
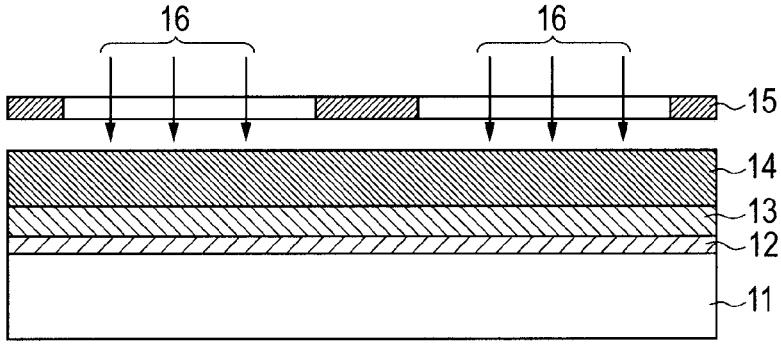

FIG. 1C illustrates a subsequent photolithography (exposure) step for forming a cavity pattern in which a photo resist (ZPN2464, manufactured by Zeon Corporation) is applied by a spinner to a thickness of approximately 2 μm to form a photo resist layer 14.

The substrate 11 is subjected to pre-baking at 110° C. for 90 seconds, then irradiated with ultraviolet rays 16 by an aligner through a photo mask 15, which has a given cavity pattern, and then subjected to heat treatment at 115° C. for 60 seconds.

Figure 1D:
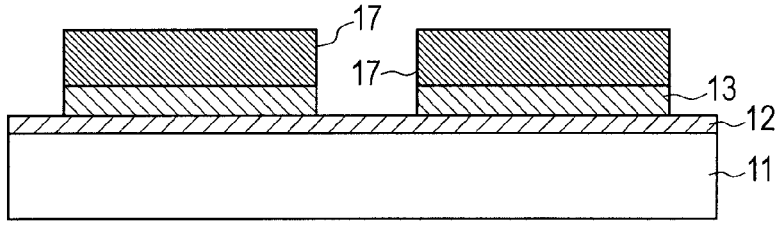

FIG. 1D illustrates a subsequent step of forming a chromium cavity pattern in which a pattern 17 is formed from a resist with the use of a developer. The pattern 17 includes cavities, which are 30 μm in diameter, and an etching channel.

The substrate 11 is subjected to post-baking at 180° C. for 3 minutes, then etched with a chromium etchant (a mixed acid chromium etchant manufactured by Kanto Chemical Co., Inc.), and then washed with water and dried.

Figure 1E:
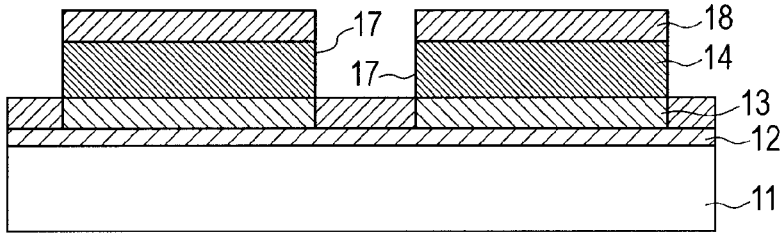

FIG. 1E illustrates a subsequent step of forming an insulating layer in which an insulating layer 18 is formed from silicon dioxide by sputtering. Instead of silicon dioxide, the insulative material may be formed from silicon nitride or other metal oxide film materials.

The insulating layer 18 may also be formed by a method that does not damage the resist, such as electron beam (EB) deposition or vacuum heating evaporation.

Preferred deposition conditions in this step are as follows.

A chamber in which the process is conducted is pumped until a degree of vacuum of $3\times10^{-5}$ Pa is reached. Thereafter, silicon dioxide is deposited for 25 minutes, with the flow rate of Ar set to 50 sccm, the pressure to 0.8 Pa, and the DC power to 300 W, to form a silicon dioxide film to a thickness of approximately 200 nm. Thereafter, the resist film is removed by ultrasonic cleaning in an acetone solution.

Figure 2A:
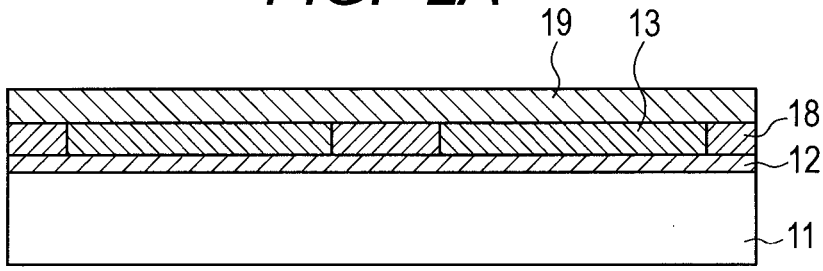
FIGS. 2A, 2B, 2C, and 2D are diagrams illustrating the method of manufacturing the capacitive electromechanical transducer according to Example 1 of the present invention, with FIG. 2A illustrating a step of forming a vibrating film which follows the step of FIG. 1E, FIG. 2B illustrating a photolithography (exposure) step for forming etching holes, FIG. 2C illustrating the photolithography (development) step for forming the etching holes, and FIG. 2D illustrating a step of forming the etching holes.

FIG. 2A illustrates a step of forming a vibrating film which follows the removal of the resist film and in which a vibrating film 19 is formed from silicon nitride by plasma CVD.

Preferred deposition conditions in this step are as follows.

A silicon nitride film having a thickness of approximately 150 nm is formed through 10 minutes of deposition in which the substrate heating temperature is set to 350° C., the RF power is set to 360 W, the chamber pressure is set to 150 Pa, the flow rate of $SiH_4$ gas is set to 24 sccm, the flow rate of $NH_3$ gas is set to 150 sccm, and the flow rate of $N_2$ gas is set to 600 sccm.

Figure 2B:
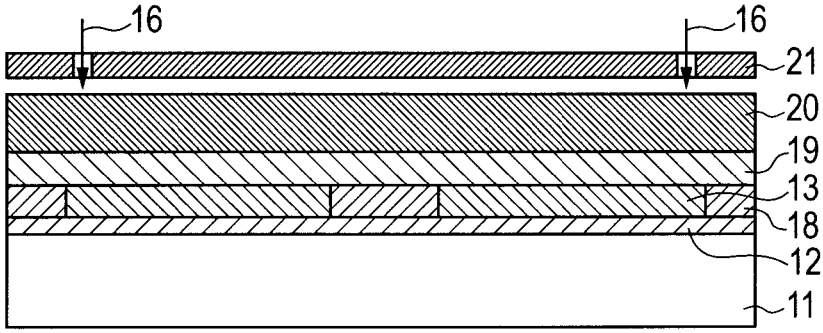
Figure 2C:
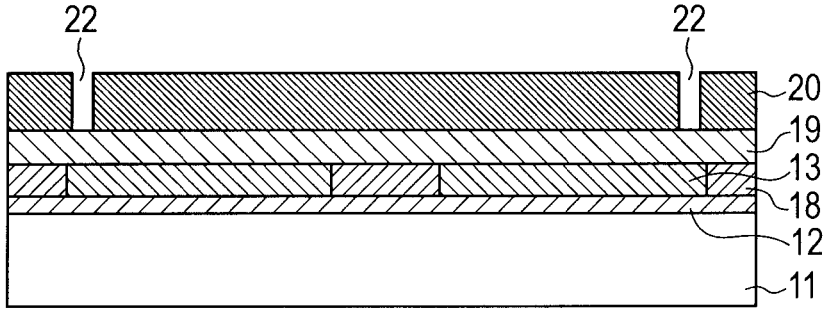

FIG. 2B illustrates a subsequent photolithography (exposure) step for forming etching holes and FIG. 2C illustrates the photolithography (development) step for forming the etching holes. In those steps, a photo resist (AZ1500, manufactured by Shipley Company L.L.C.) is applied by a spinner to a thickness of approximately 2 μm to form a photo resist layer 20.

The substrate 11 is subjected to pre-baking at 90° C. for 90 seconds, then irradiated with the ultraviolet rays 16 by the aligner through a photo mask 21, which has given etching holes, and developed with a developer to form a resist pattern for etching holes which are 8 μm in diameter. The substrate 11 is then subjected to post-baking at 120° C. for 3 minutes.

Figure 2D:
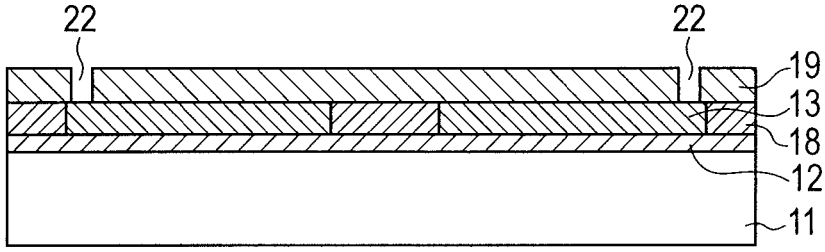

FIG. 2D illustrates a subsequent step of forming the etching holes 22 in which the silicon nitride film is etched by dry etching to form the etching holes.

Preferred deposition conditions in this step are as follows.

A chamber in which the process is conducted is pumped until a degree of vacuum of $3\times10^{-5}$ Pa is reached. Thereafter, etching is conducted for 2 minutes, with the flow rate of $CF_4$ gas set to 20 sccm, the pressure set to 5 Pa, and the DC power set to 150 W. Thereafter, the resist film is removed by ultrasonic cleaning in an acetone solution.

Figure 3A:
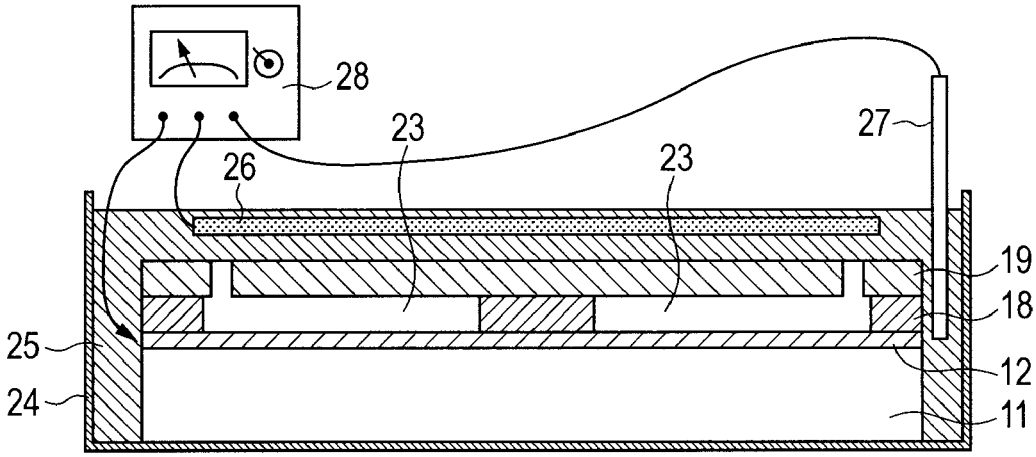
FIGS. 3A and 3B are diagrams illustrating Example 1 of the present invention, with FIG. 3A illustrating an electrolytic etching step of Example 1, and FIG. 3B illustrating a step of forming an upper electrode and sealing the etching holes.

FIG. 3A illustrates a subsequent electrolytic etching step in which the chromium film serving as the sacrificial layer 13 is removed to form cavities 23.

Preferred conditions for forming the cavities 23 in this step are as follows.

An etching bath 24 is filled with a 2 mol/L aqueous solution 25 of sodium chloride, and a platinum counter electrode 26 and a reference electrode 27 made of silver/silver chloride are arranged in the etching bath 24.

A potentiostat 28 is used to apply a DC voltage of 2 V to the lower electrode 12, thereby etching the sacrificial layer 13, which is a chromium film, for 500 seconds and forming the cavities 23.

The substrate 11 is then washed with water, subjected to water displacement with the use of isopropyl alcohol, and lastly dried with the use of a fluorine-based solvent (HFE7100, manufactured by Sumitomo 3M Limited).

While this step employs electrolytic etching to remove the sacrificial layer 13, the sacrificial layer 13 may be removed by other methods including wet etching and dry etching.

Figure 3B:
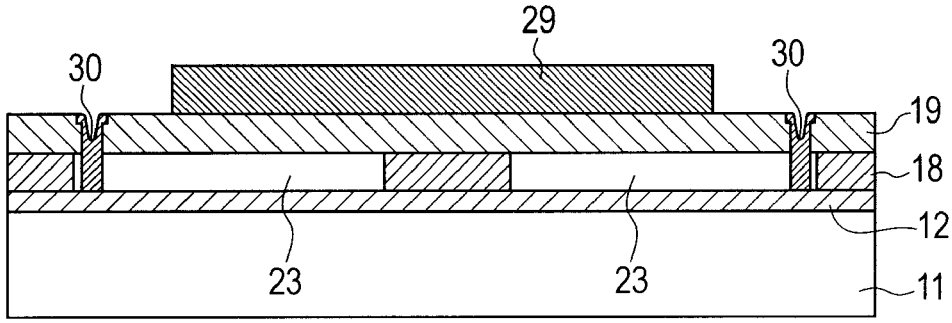

FIG. 3B illustrates a step of forming an upper electrode and sealing the etching holes in which an upper electrode 29 is formed from an aluminum film and the etching holes 22 are sealed by a sealing material 30.

Preferred deposition conditions in this step are as follows.

A chamber in which the process is conducted is pumped until a degree of vacuum of $3\times10^{-5}$ Pa is reached. Thereafter, aluminum is deposited for 300 seconds, with the flow rate of Ar set to 30 sccm, the pressure to 0.7 Pa, and the DC power to 300 W, to form an aluminum film to a thickness of approximately 300 nm.

The aluminum film is then patterned by photolithography.

Figure 4:
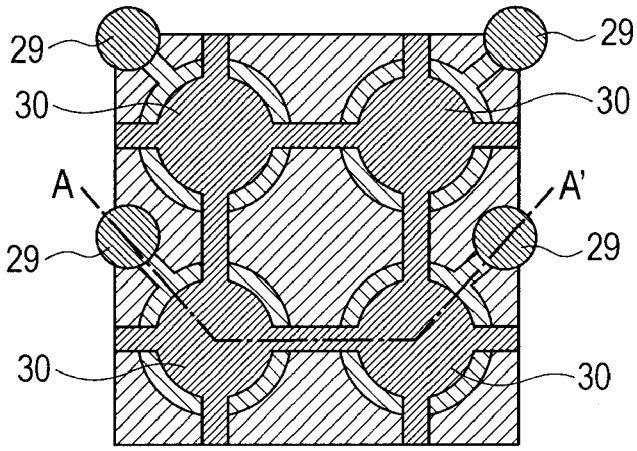
FIG. 4 is a plan view of the completed capacitive electromechanical transducer.

FIG. 4 is a plan view of a part of the completed capacitive electromechanical transducer according to the present invention.

The capacitive electromechanical transducer manufactured according to Example 1 may be reduced in vibrating film thickness, and increased in insulating layer thickness, which means that a parasitic capacitance generated outside cavities is small. The capacitive electromechanical transducer thus may acquire high-sensitivity characteristics.

EXAMPLE 2

After the chromium sacrificial layer is formed by photolithography in Example 1, a spinner is used to perform spin coating in which the sacrificial layer is coated with an inorganic $SiO_2$-based application solution for forming a coat (an SOG material manufactured by Tokyo Ohka Kogyo Co., Ltd.). The substrate is subjected to pre-baking at 100° C. for 15 minutes, and then the resist is removed with the use of acetone.

Thereafter, an insulating layer is formed through main baking conducted at 400° C. for 30 minutes, thereby completing a capacitive electromechanical transducer, which has the same characteristics as the capacitive electromechanical transducer manufactured in Example 1.

Alternatively, the insulating layer may be formed from a photosensitive $SiO_2$-based application solution for forming a coat (NHS, manufactured by Adeka Corporation) by a low temperature process.

According to the method of manufacturing the capacitive electromechanical transducer of each Example described above, the parasitic capacitance generated may be significantly reduced and a capacitive mircomachined ultrasonic transducer high in sensitivity can be manufactured.

The manufacturing methods of Examples 1 and 2 can also employ lift-off, which has a self-alignment effect, in forming an insulating layer between cavities, and therefore need less control over the thickness of a vibrating film layered on top of the insulating layer. This improves the degree of freedom in process design.

The manufacturing methods of Examples 1 and 2 are therefore capable of providing a capacitive electromechanical transducer such as a capacitive mircomachined ultrasonic transducer that is suited to a specific use chosen out of a wide range of uses.

In addition, because the manufacturing methods of Examples 1 and 2 can employ the lift-off process which requires minimum man-hour, the methods hardly affect the cost and have a high yield.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-293914, filed Dec. 25, 2009, which is hereby incorporated by reference herein in its entirety.

What is claimed is:

1. A method of manufacturing a capacitive electromechanical transducer, comprising:

forming a lower electrode layer on a substrate;

forming a sacrificial layer on the lower electrode layer;

forming by application a resist layer on the sacrificial layer to form a cavity pattern;

forming an insulating layer above regions including a region that contains the resist layer used to form the cavity pattern, and then performing a removal step of removing a part of the insulating layer that is formed above the resist layer along with the resist layer, thereby leaving the insulating layer in the other regions than the region where the cavity pattern has been formed;

forming a vibrating film above the region where the cavity pattern has been formed and the regions where the insulating layer remains; and removing, after the vibrating film is formed, the sacrificial layer from the region where the cavity pattern has been formed to form a cavity.

2. The method of manufacturing a capacitive electromechanical transducer according to claim 1, wherein the insulating layer that remains in the other regions than the region where the cavity pattern has been formed has the same thickness as the sacrificial layer has.

3. The method of manufacturing a capacitive electromechanical transducer according to claim 1, wherein the insulating layer is formed from an insulative material that contains at least one of silicon nitride and silicon oxide.

4. The method of manufacturing a capacitive electromechanical transducer according to claim 1, wherein, in said removing step, the sacrificial layer is removed by one type of etching selected from the group consisting of electrolytic etching, wet etching, and dry etching.

* * * * *